US005220856A

United States Patent [19]

Eggert et al.

[11] Patent Number: 5,220,856

[45] Date of Patent: Jun. 22, 1993

[54] PIVOTAL HAND TOOL AND PIVOT JOINT THEREFOR

[75] Inventors: Daniel M. Eggert; Jeffrey H. Hoff, both of Kenosha; Bert Krivec, Waukesha; Frank Mikic, Kenosha; Christopher D. Thompson, Milwaukee, all of Wis.

[73] Assignee: Snap-on Tools Corporation, Kenosha, Wis.

[21] Appl. No.: 696,715

[22] Filed: May 7, 1991

[51] Int. Cl.[5] ..... B26B 13/00; B25B 7/06

[52] U.S. Cl. ..... 81/416; 30/254

[58] Field of Search ..... 81/411, 412, 413, 414, 81/415, 416, 417; 30/191, 193, 254

[56] References Cited

U.S. PATENT DOCUMENTS

| | | | |
|---|---|---|---|
| 832,200 | 10/1906 | Kellemen et al. . | |
| 1,152,633 | 9/1915 | Holtgrave . | |
| 1,778,346 | 10/1930 | Zeidler . | |
| 1,885,895 | 11/1932 | Carey . | |
| 2,088,224 | 7/1937 | Aiken . | |
| 2,243,086 | 5/1941 | Buettell | 81/412 |
| 2,274,945 | 3/1942 | Van Keuren | 30/254 |
| 2,611,288 | 9/1952 | Schiffbauer . | |
| 2,729,996 | 1/1956 | Schoenwald | 81/415 |
| 2,741,843 | 4/1956 | Sejman et al. . | |
| 2,939,214 | 6/1960 | Andersson et al. . | |
| 3,005,366 | 10/1961 | Grimshaw et al. . | |
| 3,170,237 | 2/1965 | Weidauer . | |
| 3,650,028 | 3/1972 | La Pointe | 81/416 |
| 3,763,726 | 10/1973 | Hildebrand . | |
| 3,833,953 | 9/1974 | Fisher et al. | 81/416 |
| 3,952,749 | 4/1976 | Fridolph | 30/254 |
| 4,290,545 | 9/1981 | Whitney | 228/139 |
| 4,478,532 | 10/1984 | Puro . | |
| 4,603,607 | 8/1986 | Schaffner, Jr. . | |
| 4,669,340 | 6/1987 | Igarashi | 81/416 |
| 4,843,927 | 7/1989 | Gulistan . | |
| 4,882,959 | 11/1989 | Sakai . | |
| 4,907,477 | 3/1990 | Farber | 81/416 |

FOREIGN PATENT DOCUMENTS

| | | | |
|---|---|---|---|
| 214107 | 3/1987 | European Pat. Off. | 81/417 |

*Primary Examiner*—Frank T. Yost
*Assistant Examiner*—Paul M. Heyrana, Sr.
*Attorney, Agent, or Firm*—Emrich & Dithmar

[57] ABSTRACT

A pivotal hand tool includes first and second lever members which intersect and have aligned openings therethrough in which is received a pivot pin having an enlarged head at one end adjacent to one of the lever members and having the other end thereof welded to the other lever member or to a flat washer which bears against the other lever member. The head and the flat washer may be received in complementary recesses in the lever members. A frustoconical washer may be disposed beneath the head of the pivot pin for resiliently urging the lever members together.

11 Claims, 1 Drawing Sheet

PIVOTAL HAND TOOL AND PIVOT JOINT THEREFOR

BACKGROUND OF THE INVENTION

1. Field of the Invention

The present invention relates to pivotal hand tools with cooperating jaws, such as pliers, cutters or the like, and, in particular, to a pivot joint therefor.

2. Description of the Prior Art

There are many types of pivotal hand tools, such as various types of pliers and cutters, and they all typically include a pair of lever members each having a handle portion at one end and a jaw portion at the other end and arranged in intersecting relationship for pivotal movement about a pivot axis through the point of intersection so that the jaw portions cooperate with each other. Various types of pivot joints are provided for such hand tools. A common type of joint involves arranging the lever members in overlapping relationship with aligned openings therethrough and a pivot member extending through the aligned openings. In one such arrangement a rivet extends through the aligned openings to define a pivot pin. But in this kind of pivot joint the rivet must be formed of a relatively soft material so that the rivet can be deformed after insertion through the aligned openings to lock it in place on the assembly. This means that the rivet cannot be heat treated before assembly and that the finished hand tool must be heat treated after it has been assembled. Heat treatment after assembly often causes the lever members or tool halves to "lock" together, a situation which is commonly manually corrected with the use of a hammer and anvil. This is a considerable inconvenience.

An alternative pivot joint which does not use rivets involves interlocking threaded fasteners extending through the aligned openings to form the pivot member. One such arrangement utilizes frustoconical threaded members disposed in chamfered openings through the lever members so that drawing the two threaded members together will serve to clamp the lever members together. But this arrangement creates considerable wear on the threaded pivot members.

An alternative threaded pivot arrangement utilizes two headed cylindrical pivot members, one male and one female, but in this type of joint the threaded pivot members and the lever members must be designed to very close tolerances so that they will hold the lever members securely together with just the right degree of tightness. Furthermore, such threaded joints have a tendency to loosen during use and must be periodically tightened to maintain the proper degree of tightness.

SUMMARY OF THE INVENTION

It is a general object of the present invention to provide an improved pivotal hand tool and pivot joint therefor, which avoids the disadvantages of prior constructions while affording additional structural and operating advantages.

An important feature of the invention is the provision of a pivot joint which may be formed of fully heat-treated parts so as to obviate heat treating after assembly.

Another feature of the invention is the provision of a pivot joint of the type set forth which does not require the use of rivets.

Still another feature of the invention is the provision of a pivot joint of the type set forth which provides the proper tension between the joined lever members without the need for very close tolerances on the pivot and lever members.

Yet another feature of the invention is the provision of a pivot joint of relatively simple and economical construction which minimizes wear.

Another feature of the invention is the provision of a pivotal hand tool incorporating a pivot joint of the type set forth.

These and other features of the invention are attained by providing a pivotal hand tool comprising: first and second lever members respectively having cooperating jaws at adjacent ends thereof, the lever members being disposed in intersecting relationship and respectively having aligned openings therethrough, a pivot member extending through the aligned openings and having an axis about which the lever members may pivot, stop means integral with the pivot member at one end thereof and dimensioned for engagement with the first lever member to prevent passage through the openings, weldment means on the pivot member adjacent to the other end thereof cooperating with the stop means and the lever members to prevent removal of the pivot member from the openings, and bias means resiliently urging the lever members relative to each other along the axis.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there are illustrated in the accompanying drawings preferred embodiments thereof, from an inspection of which, when considered in connection with the following description, the invention, its construction and operation, and many of its advantages should be readily understood and appreciated.

DESCRIPTION OF THE PREFERRED EMBODIMENTS

Figure 1:
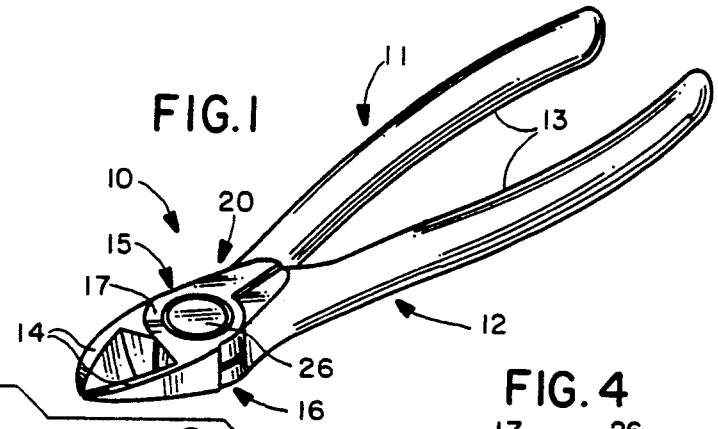
FIG. 1 is a perspective view of a pivotal hand tool constructed in accordance with and embodying the features of a first embodiment of the present invention.
Figure 2:
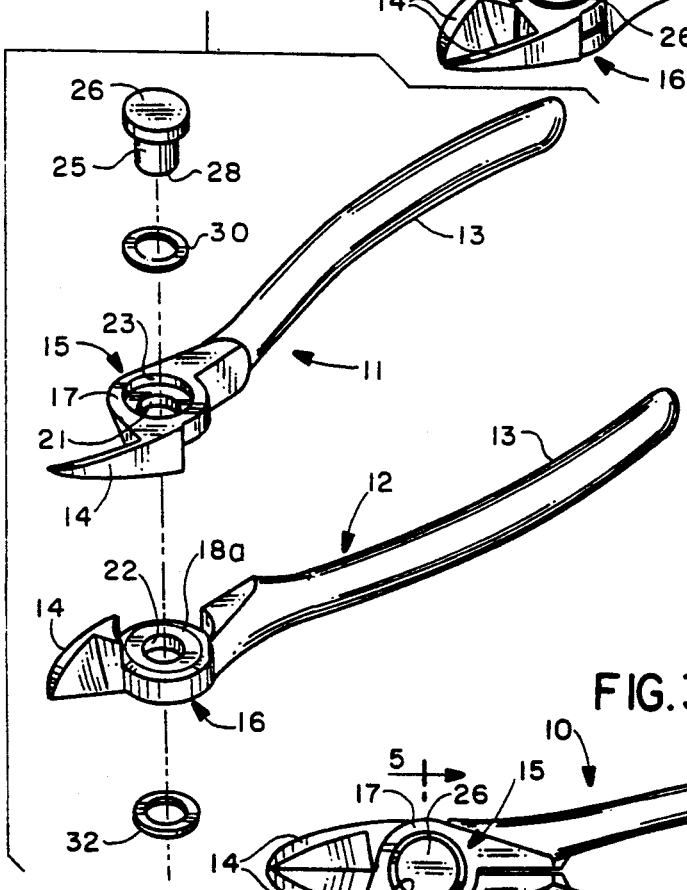
FIG. 2 is an exploded perspective view of the hand tool of FIG. 1.
Figure 4:
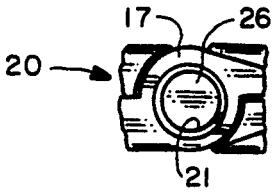
FIG. 4 is a fragmentary top plan view of the pivot joint of the hand tool of FIG. 3.
Figure 5:
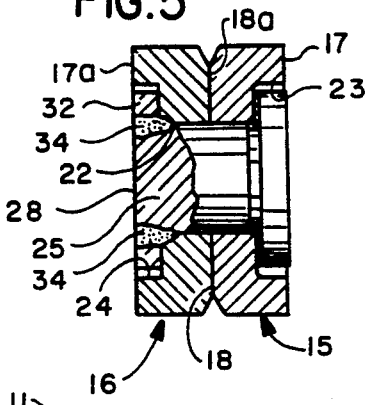
FIG. 5 is an enlarged view in vertical section taken along the line 5—5 in FIG. 3, and illustrating the pivot joint.
Figure 3:
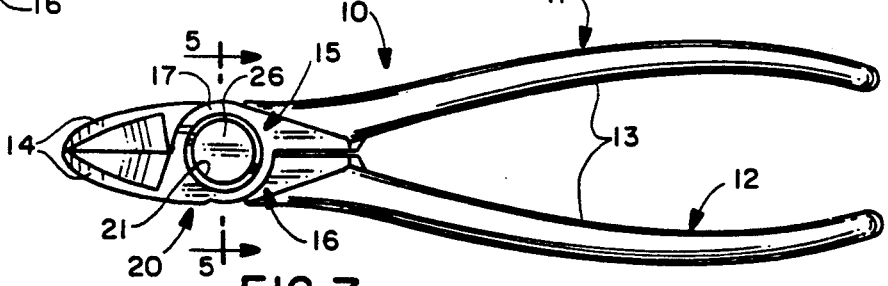
FIG. 3 is a top plan view of the hand tool of FIG. 1.

Referring to FIGS. 1-3, there is illustrated a pivotal hand tool 10, in the form of a cutter, constructed in accordance with and embodying the features of a first embodiment of the present invention. The hand tool 10 includes a pair of lever members 11 and 12, each having a handle 13 at one end thereof and a jaw 14 at the other end thereof. Referring also to FIGS. 4 and 5, the lever members 11 and 12, respectively, have pivot bodies 15 and 16 intermediate the handle 13 and the jaw 14, the pivot body 15 having an outer surface 17 and an inner surface 18 while the pivot body 16 has and outer surface 17*a* and an inner surface 18*a*.

Figure 6:
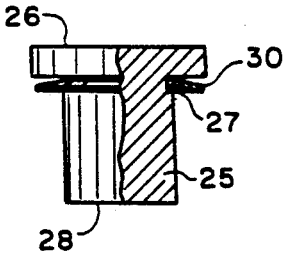
FIG. 6 is an enlarged front elevational view in partial section of the pivot pin and bias spring of the pivot joint of FIG. 5.

In use, the lever members 11 and 12 are disposed in intersecting relationship with the pivot bodies 15 and 16 overlapping and forming part of a pivot joint 20. More specifically, the pivot body 15 has a cylindrical bore or opening 21 extending therethrough between the outer and inner surfaces 17 and 18, while the pivot body 16 has a cylindrical bore or opening 22 extending therethrough between the outer and inner surfaces 17*a* and 18*a*. In use, the pivot bodies 15 and 16 overlap so that the bores 21 and 22 are aligned. Enlarged-diameter counterbore recesses 23 and 24 are respectively formed in the outer surfaces 17 and 17*a* of the pivot bodies 15 and 16 coaxially with the bores 21 and 22. Referring also to FIG. 6, the pivot joint 20 includes a cylindrical pivot pin 25 having an enlarged-diameter head 26 unitary therewith at one end thereof. A shallow circumferential groove 27 is formed in the outer surface of the pivot pin 25 at the end thereof adjacent to the head 26 (see FIGS. 5 and 6). A bias element 30, preferably in the form of a frustoconical washer such as a Belleville washer, is disposed around the pivot pin 25 in the circumferential groove 27.

In use, the pivot pin 25 is fitted through the aligned bores 21 and 22, with the head 26 disposed in the counterbore recess 23 so that the bias element 30 is disposed against the pivot body 15. The pivot pin 25 has a length such that it extends all the way through the pivot body 16. In assembly, the pivot pin 25 is pushed well into the aligned bores 21 and 22 so that the head 26 compresses the bias element 30. It will be appreciated that the head 26 has a diameter substantially greater than that of the bores 21 and 22 so that it serves as a stop member to prevent the pivot pin 25 from falling out of the aligned bores 21 and 22. A flat washer 32 is disposed in the counterbore recess 24 in the pivot body 16 in encircling relationship with the distal end 28 of the pivot pin 25 and is fixedly secured to the latter by a weldment 34. The circumferential groove 27 serves to prevent interference between the pivot pin 25 and the corner of the pivot body 15 at the junction between the bore 21 and the counterbore recess 23.

It will be appreciated that when the parts are assembled in the manner illustrated in FIG. 5, the bias element 30 operates resiliently to tend to separate the head 26 from the pivot body 15, thereby resiliently urging the pivot bodies 15 and 16 together axially of the pivot pin 25 by cooperation with the flat washer 32. This serves to maintain a predetermined tension between the pivot bodies 15 and 16, preventing the jaws 14 from falling open from their own weight and maintaining a proper cutting relationship between them. The constant tension applied by the bias element 30 serves to prevent loosening of the pivot joint 20 in use. In prior tools, on the other hand, the tension between the pivot bodies 15 and 16 that prevents the jaws from falling open was commonly obtained through interference of a frustoconical rivet and a mating countersink, the interference commonly being achieved through a hand joint adjusting operation using hammers and anvils.

Because no rivet is used in the joint 20, the parts can all be hardened by heat treating before assembly to minimize wear. Wear is also limited by reason of the fact that the pivot pin 25 and the bores 21 and 22 are cylindrical, so that all of the operative wear surfaces are either parallel to or perpendicular to the axis of the pivot pin 25. In the event that, after assembly, the distal end 28 of the pivot pin 25 projects slightly beyond the outer surface 17*a* of the pivot body 16, the distal end 28 could be ground down flush. The distal end 28 and the head 26 may also be polished to enhance visual appearance.

Figure 7:
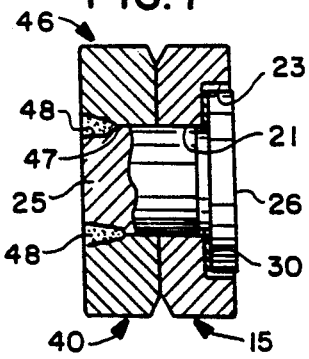
FIG. 7 is a view similar to FIG. 5 of an alternative embodiment of the pivot joint of the present invention.

Referring now also to FIG. 7, there is illustrated another form of pivot joint, generally designated by the numeral 40, in accordance with the present invention. The pivot joint 40 is similar to the pivot joint 20 and like parts have like reference numerals. In this case, the lever member 12 has a pivot body 46 which has a cylindrical bore 47 therethrough which aligns with the bore 21 in the pivot body 15 coaxially therewith, but which has no counterbore recess. In this case, no flat washer is provided and the distal end 28 of pivot pin 25 is fixedly secured by weldment 48 directly to the pivot body 46. Otherwise, the pivot joint 40 functions in the same way as the pivot joint 20 described above.

Figure 8:
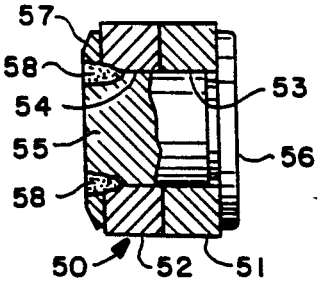
FIG. 8 is a view similar to FIG. 5, of yet another embodiment of the pivot joint of the present invention.

Referring to FIG. 8, there is illustrated a pivot joint 50 constructed in accordance with a further embodiment of the present invention. In this case, the lever members 11 and 12, respectively, have pivot bodies 51 and 52 with aligned cylindrical bores 53 and 54 formed respectively therethrough. A cylindrical pivot pin 55 extends through the bores 53 and 54, the pivot pin 55 having an enlarged-diameter head 56 which bears against the outer surface of the pivot body 51 and serves as a stop means. The distal end of the pivot pin 55 projects beyond the outer surface of the pivot body 52 and is encircled by a flat washer 57 which bears against the pivot body 52 and is secured by a weldment 58 to the pivot pin 55.

In the embodiments of FIGS. 5 and 8, the pivot bodies 15 and 16 and 51 and 52 are preferably formed of a high-carbon metal alloy to improve wear resistance. Such high-carbon materials are not conducive to welding, but their use is permitted by forming the flat washer 32 or 57 and the pivot pin 25 or 55 from lower-carbon materials to facilitate welding.

While in the preferred embodiments the pivot pin is provided with an enlarged head unitary therewith to serve as the stop means, it will be appreciated that other stop means, such as enlarged nuts or washers and the like, may also be fixedly secured to one end of the pivot pin to serve as the stop member. Further, while the bias element 30 is preferably disposed beneath the head 26, it will be appreciated that it could also be provided beneath the washer 32 in the embodiment of FIG. 5. If desired, a bias element could alternatively be provided between the pivot bodies (e.g., 15 and 16) of the lever members 11 and 12 to resiliently urge them apart, depending upon the nature of the tool and the desired relationship between the jaws 14. Such a bias arrangement would still serve to maintain a tension in the pivot joint and prevent the jaws 14 from loosely falling apart open under their own weight. While a Belleville washer is provided as the bias element 30 in the preferred embodiment, it will be appreciated that other types of elements such as a wave washer, a lock washer or a tension spring interconnecting the outer surfaces of the pivot bodies 15 and 16 could be used.

From the foregoing, it can be seen that there has been provided an improved pivotal hand tool and pivot joint therefor which avoids the use of rivets and yet provides a simple and economical construction which minimizes wear and maintains a predetermined joint tension without the need for providing parts to very close tolerances.

We claim:

1. A pivotal hand tool comprising: first and second lever members respectively having cooperating jaws at adjacent ends thereof, said lever members being disposed in intersecting relationship and respectively having aligned openings therethrough, a cylindrical pivot member extending through said aligned openings and having an axis about which said lever members may pivot, stop means integral with said pivot member at one end thereof and dimensioned for engagement with said first lever member to prevent passage through said openings, said pivot member having a reduced diameter portion thereon adjacent to one end thereof and extending to said stop means, a washer encircling said pivot member adjacent to the other end thereof and welded thereto and dimensioned and disposed for engagement with said second lever member to cooperate with said stop means to prevent removal of said pivot member from said openings, and bias means disposed in encircling relationship with said reduced-diameter portion of said pivot member between said stop means and the adjacent one of said lever members for resiliently urging said pivot bodies relative to each other along said axis.

2. The hand tool of claim 1, wherein said stop means comprises an enlarged head on said pivot member.

3. The hand tool of claim 2, wherein said bias means includes a conical washer.

4. The hand tool of claim 1, wherein said second lever member has a recess formed therein in which said washer is disposed.

5. The hand tool of claim 4, wherein said first lever member has a recess therein in which stop means is disposed.

6. The hand tool of claim 1, wherein said bias means includes a frustoconical washer.

7. The hand tool of claim 6, wherein said bias means resiliently urges said lever members together.

8. A pivot joint for a hand tool with two pivoted jaws comprising: two pivot bodies respectively integral with the jaws and disposed in overlapping relationship and respectively having aligned openings therethrough, a cylindrical pivot member extending through said aligned openings and having an axis about which said bodies may pivot, stop means integral with said pivot member at one end thereof and dimensioned for engagement with the adjacent one of said bodies to prevent passage through said openings, said pivot member having a reduced diameter portion thereon adjacent to one end thereof and extending to said stop means, a washer encircling said pivot member adjacent to the other end thereof and welded thereto and dimensioned and disposed for engagement with the other of said bodies for cooperating with said stop means and said bodies to prevent removal of said pivot member from said openings, and bias means disposed in encircling relationship with said reduced-diameter portion of said pivot member between said stop means and the adjacent one of said lever members for resiliently urging said pivot bodies relative to each other along said axis.

9. The hand tool of claim 8, wherein said stop means is disposed in a recess in the adjacent one of said pivot bodies.

10. The pivot joint of claim 8, wherein said bias means includes a conical washer.

11. The pivot joint of claim 8, wherein said pivot body adjacent to said one end of said pivot member has a recess therein in which said stop means is received.

* * * * *

UNITED STATES PATENT AND TRADEMARK OFFICE

CERTIFICATE OF CORRECTION

PATENT NO. : 5,220,856

DATED : June 22, 1993

INVENTOR(S) : Daniel M. Eggert et al.

It is certified that error appears in the above-identified patent and that said Letters Patent is hereby corrected as shown below:

Column 6, line 6, "6" should be --1--.

Signed and Sealed this

Twenty-ninth Day of November, 1994

*Attest:*

Bruce Lehman

BRUCE LEHMAN

*Attesting Officer*

*Commissioner of Patents and Trademarks*